United States Patent [19]

Bongers et al.

[11] Patent Number: 4,778,102

[45] Date of Patent: Oct. 18, 1988

[54] FOLDING BOX WITH AN INTEGRATED DISPENSER

[75] Inventors: Bernhard Bongers; Horst Bertram, both of Duesseldorf; Dierk-Ulrich Herrmann, Neuss; Werner Kuenzel, Langenfeld, all of Fed. Rep. of Germany

[73] Assignee: Henkel Kommanditgesellschaft auf Aktien, Duesseldorf, Fed. Rep. of Germany

[21] Appl. No.: 59,660

[22] Filed: Jun. 8, 1987

[30] Foreign Application Priority Data

Jun. 7, 1986 [DE] Fed. Rep. of Germany ..... 3619215

[51] Int. Cl.[4] ..... G01H 11/26

[52] U.S. Cl. ..... 229/125.15; 229/125.19; 229/160.2; 222/454; 222/455

[58] Field of Search ..... 229/123.3, 123.2, 122, 229/122.1, 125.15, 125.19, 160.2, 20; 222/56, 454, 455, 456, 547, 564, 572

[56] References Cited

U.S. PATENT DOCUMENTS

| | | | |
|---|---|---|---|
| 2,393,262 | 1/1946 | Percy | 222/455 |
| 2,750,082 | 6/1956 | Kowal | 222/455 |
| 2,996,224 | 8/1961 | Silver | 222/455 |
| 3,184,137 | 5/1965 | Mohler | 229/166.2 |
| 3,235,144 | 2/1966 | Pitkin et al. | 222/455 |
| 3,669,322 | 6/1972 | Popiualo | 222/454 |
| 3,698,606 | 10/1972 | Wakamatsu | 222/454 |

*Primary Examiner*—Willis Little

*Attorney, Agent, or Firm*—Ernest G. Szoke; Henry E. Millson, Jr.; Real J. Grandmaison

[57] ABSTRACT

A folding box with an integrated dispenser and pouring opening for powder products and granulates to provide for uniform dispensing, even during the first dispensing process, and to be made in one piece on erection of the folding box from a flat box blank. The dispenser has a dispensing duct wall which extends over the entire width of the pouring side wall transversely of the pouring opening and which is cut below the height of the pouring opening and displaced parallel into the interior of the box to form a wall of the dispensing chamber. The wall of the dispensing chamber is fixed at the base of the dispensing chamber by means of a pressure tongue secured to the pouring side wall.

21 Claims, 6 Drawing Sheets

FOLDING BOX WITH AN INTEGRATED DISPENSER

BACKGROUND OF THE INVENTION

1. Field of the Invention

This invention relates to a folding box with a pouring opening provided at the upper end of a pouring side wall, and more particularly, to an integrated dispenser therien for free-flowing powder products and granulates preceding the pouring opening inside the box with an additional box wall hinged to the pouring side wall and consisting of a dispensing duct wall which extends over the entire width of the pouring side wall transversely of the pouring opening and which is cut and displaced parallel into the interior of the box at the cut to form a dispensing chamber wall, being designed for connection to the box side wall hinged to the pouring side wall.

2. Discussion of Related Art

A folding box of the type herein is described in U.S. Pat. No. 2,750,082. The additional, so-called fifth box side provided in the box blank of the prior art box is designed in such a way that it can be introduced and glued in place during the glueing process and, on erection of the folding box, automatically opens up a dispenser inside the box. The known dispenser consists of a double wall which extends over the width and height of the box and which, in the lower part of the box opposite the pouring opening, is cut and displaced into the interior of the box. This results in the formation of a so-called predispensing chamber at the bottom of the erected box. When a powder-filled box is tilted through approximately 135°, the powder inside the box flows from the pre-dispensing chamber to the pouring opening, the double wall and the shorter wall of the pre-dispensing chamber displaced into the interior of the box preventing the powder from following through.

U.S. Pat. No. 2,393,262 describes a folding box wherein the pouring opening is preceded inside the box by two additional walls extending over the width-/height of the box. The additional wall situated next to the pouring side wall is formed with a notch near its base while the other additional wall is notched at its upper end substantially level with the pouring opening.

Although the known dispensers provide for relatively uniform dispensing, they are attended by the disadvantage that the space defined by the double wall towards the interior of the box fills with product when the box is carried upside down or turned upside down, for example on the way home after shopping, so that the first dispensing of product can exceed the permitted or intended value by several times. Another disadvantage is that the known dispensers occupy a disproportionately large space inside the box so that the useful box volume is correspondingly reduced.

DESCRIPTION OF THE INVENTION

An object of the present invention is to provide an integrated dispensing system of a folding box which is spatially adapted to the dispensing requirements and which always dispenses the same amount of contained product during emptying of the box with no danger of overdispensing where the box has been carried upside down or has been repeatedly turned over. According to the invention, this object is achieved in the afore-mentioned folding box wherein a dispensing duct wall is cut where it adjoins the pouring opening and wherein a dispensing chamber wall is folded downwards towards the pouring side wall at a predetermined dispensing height below the cut to form a dispensing chamber and is fixed as the base of the dispensing chamber between the pouring side wall and a pressure tongue fastened thereto. The base of the dispensing chamber in the erected folding box preferably slopes obliquely downwards from the wall of the dispensing chamber towards the pouring side wall. Further embodiments of the invention are described in the following and in the following appended claims.

The invention provides a folding box wherein the box blank has at least one so-called fifth side wall with the elements of an integrated dispensing system. In the box blank, the individual elements of the dispenser, which engage with one another after erection, lie adjacent to one another in one place so that the folding box according to the invention erects in substantially the same way as the box known from U.S. Pat. No. 2,750,082 earlier mentioned.

An important feature of the folding box according to the invention is that the dispensing chamber can be placed completely in the upper corner of a folding box containing the pouring opening without any need for significant additional manipulations or extra material compared with the prior art to make the base of the dispensing chamber.

Another feature is that it is possible by means of the cut pressure tongue to press the base of the dispensing chamber sufficiently tightly onto the pouring side wall and the box wall hinged thereto to fill the dispensing chamber with the product to be dispensed.

BRIEF DESCRIPTION OF THE DRAWINGS

Examples of the embodiments of the invention are described in detail in the following with reference to the accompanying drawings, wherein.

DETAILED DESCRIPTION OF THE DRAWINGS

Figure 1:
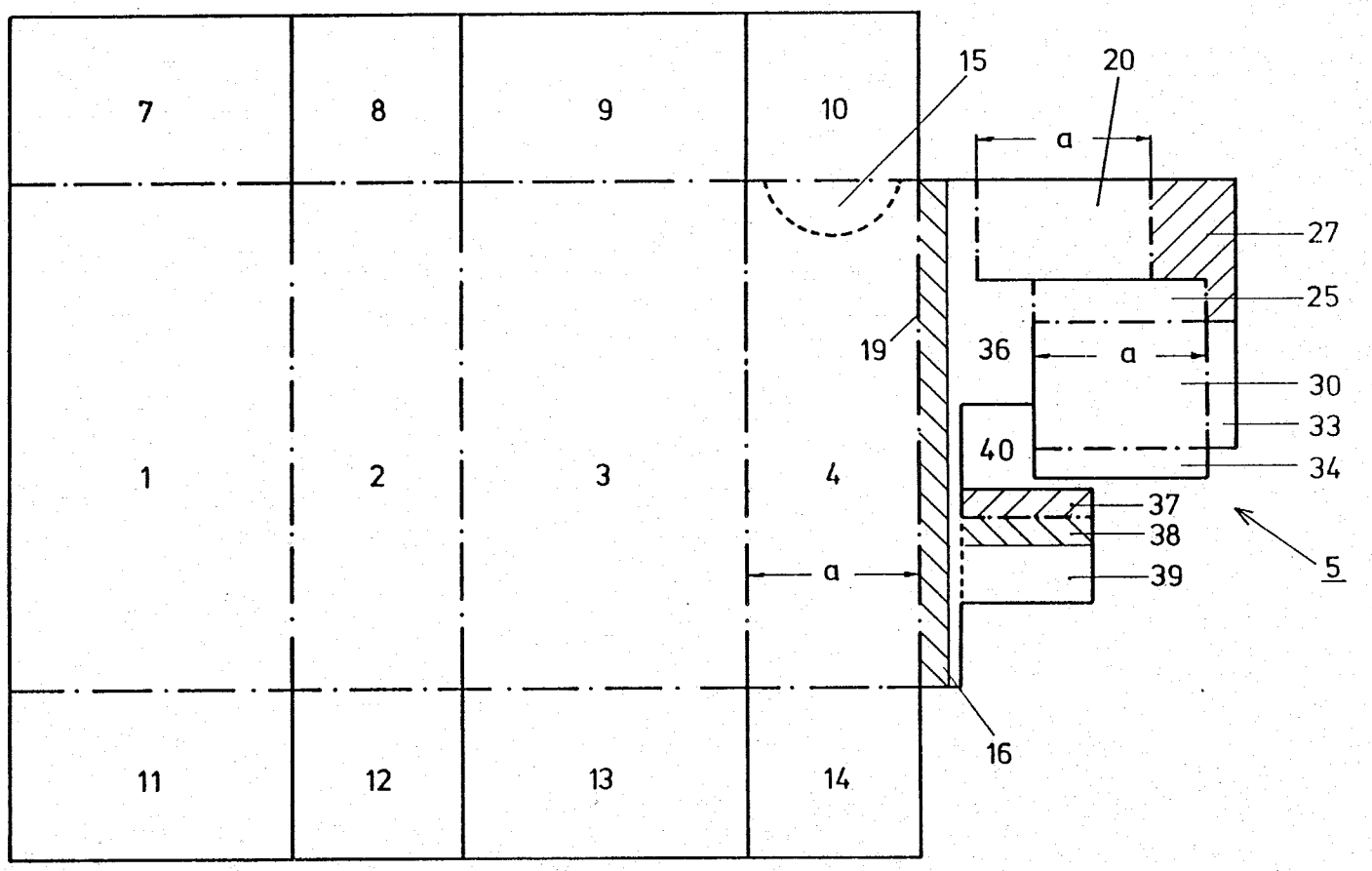
FIG. 1 illustrates a flat box blank for making a folding box with an integrated dispenser.

The flat box blank shown in FIG. 1 consists essentially of side walls 1, 2, 3 and 4 and of the so-called "fifth" side wall generally denoted by the reference 5 hinged to side wall 4. In the embodiment shown in FIG. 5, a "sixth" side wall generally denoted by the reference 6 is provided in addition to the fifth side wall 5. Fully overlapping upper flaps 7, 8, 9 and 10 and lower flaps 11, 12, 13 and 14 are hinged to side walls 1 to 4 as shown in FIGS. 1 to 5. The side wall 4, the so-called pouring side wall, has a pouring opening 15. A longitudinal glueing flap 16 is provided for erection of the box blank as shown in FIG. 1. In the box blank shown in FIG. 5, the longitudinal glueing flap 16 is divided into two sections and denoted by the references 17 and 18.

Details of the box blank shown in FIG. 1 of importance in the present invention are described in the following with reference to FIGS. 2 to 4. The fifth side wall 5 is formed integrally with the longitudinal edge 19 of the pouring side wall 4 via the longitudinal glueing flap 16. Provided opposite the pouring opening 15 is a dispensing duct wall 20 the edges of which running parallel to the longitudinal edge 19 are in the form of crease lines 21 and 22, while the inner edge extending parallel to the upper edge of the box or rather to the narrow side edge 23 of the pouring side wall 4 is a cut line 24. The dispensing chamber wall 25 adjoins the dispensing duct wall 20 beyond the cut line 24.

The cut line 24 is intended to be continued along the dispensing chamber wall 25 to the end thereof. A glueing surface adjoins the dispensing duct wall 20 and the dispensing chamber wall 25 laterally outside via the crease line 22 and a crease line 26. The dispensing chamber wall 25 has a crease line 28 on the side opposite the crease line 26 and another crease line 29 on the side opposite the cut line 24. The crease line 29 is adjoined by a dispensing chamber base 30 which faces the longitudinal glueing flap 16 is a cut line 35. The dust flaps 33 and 34 are also cut out entirely from the material. As can be seen, the dispensing duct wall 20, the dispensing chamber wall 25 and the base 30 of the dispensing chamber and also the glueing surface 27 are joined to the longitudinal glueing flap 16 and hence to the pouring side wall 4 solely via the crease line 21, 28 and via bridge material 36.

Figure 2:
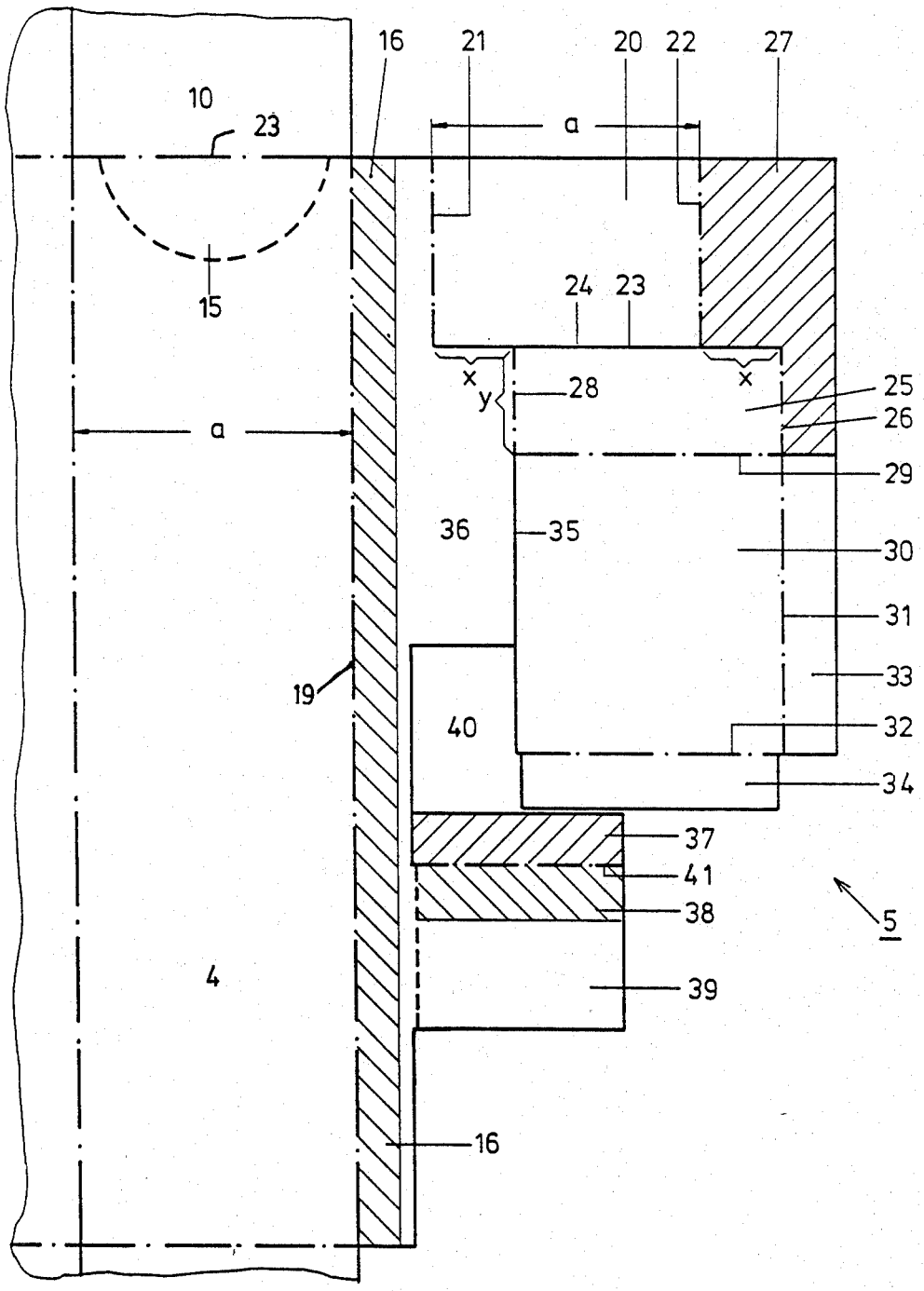
FIG. 2 is an enlarged illustration of FIG. 1.
Figure 3:
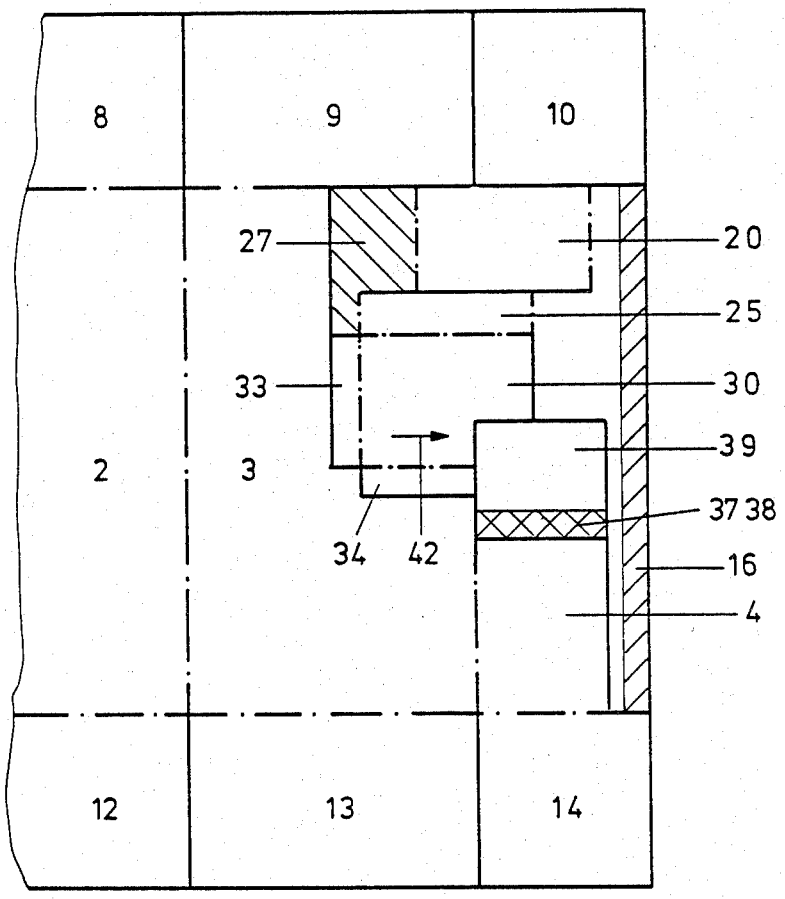
FIG. 3 shows part of the box blank of FIG. 1 with the fifth side wall turned through 180°.
Figure 4:
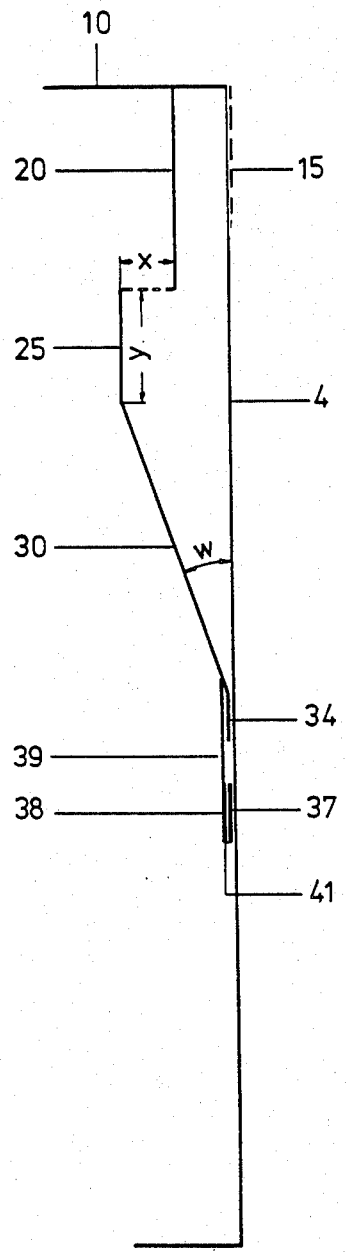
FIG. 4 illustrates a perpendicular section of the pouring side wall of an erected folding box of the type shown in FIGS. 1 and 3.

In addition, in the embodiment shown in FIGS. 1 to 3, the box blank parts of a pressure tongue are formed integrally with the longitudinal glueing flap 16 and hence directly with a pouring side wall 4. As shown in FIG. 2, the blank for the pressure tongue consists of two glueing flaps 37 and 38 and a carton flap 39. As far as the function of the pressure tongue to be erected from the parts 37 to 39 is concerned, it is of advantage for the adjoining region 40 in FIG. 2 to be cut out between the longitudinal glueing flap 16 and the base 30 of the dispensing chamber.

To erect the box blank shown in FIGS. 1 and 2, the fifth wall as a whole is first folded through 180° about the longitudinal edge 19 of the pouring side wall 4 onto the pouring side wall 4 and the adjacent side wall 3, as shown in FIG. 3. The side wall 3 is thus glued to the glueing surface 27 while the pouring side wall 4 is glued to the glueing surface 37. In a following step, the carton flap 39 with the glueing flap 38 is turned through 180° about a crease line 41 provided between the glueing flaps 37 and 38 so that the carton flap 39 in its role as a pressure tongue lies loosely on the blank surface forming the base 30 of the dispensing chamber when the glueing flaps 37 and 38 are glued together.

To erect the folding box, the side walls 3 and 4 are turned through 90° towards one another so that the dispensing duct wall 20 and the dispensing chamber wall 25 are bent at their creases 21, 22, 26 and 28 are raised from the plane of the flat box blank. During this movement, the base 30 of the dispensing chamber is pushed in the arrowed direction 42 (FIG. 3) further beneath the carton flap 39 acting as a pressure tongue so that the pressure tongue presses the base 30 of the dispensing chamber against the pouring side wall 4 and, by bending at the creases 29 and 32, into the oblique position shown in FIG. 4. In addition, during the erection process, the longitudinal glueing flap 16 is turned through 90° relative to the plane of the pouring side wall 4 and may be used for joining to the side wall 1 to be folded up.

During the described erection process, the integrated dispensing chamber is automatically erected. As can be seen by comparing FIGS. 1 to 3 and FIG. 4, the dispensing duct wall 20 of the erected folding box is opposite the pouring opening 15 in the upper part of the box and through the delimitation from the interior of the box prevents the product from following through during the particular dispensing process.

Because the dispensing duct wall 20, the dispensing chamber wall 25 and the base 30 of the dispensing chamber have to fill the entire cross-section of the erected folding box, the width "a" of the elements 20, 25 and 30 has to be equal to the width "a" of the pouring side wall 4. Through the lateral stagger x of the dispensing duct wall 20 and the dispensing chamber wall 25 in the box blank shown in FIG. 2, the distance between the walls 20 and 25 in the erected folding box is predetermined (see FIG. 4). The length y in FIG. 2 is a measure of the height of the dispensing chamber and hence, in the same way as x, a measure of the volume of the dispensing chamber integrated into the upper corner of the box containing the pouring opening. In practice, it has been found to be desirable to select the length of the dispensing chamber base 30 as measured in the direction of the longitudinal edge 19 in such as way that, on erection, the base 30 includes an angle w (FIG. 4) of from 28° to 35° with the pouring side wall 4.

The folding box erected from the box blanks shown in FIGS. 1 to 3 is very easy to handle. The box merely has to be turned through more than 90° so that the side wall 4 with the pouring opening 15 passes substantially into the horizontal. During this tilting movement through more than 90°, the contents of the dispensing chamber are emptied through the pouring opening 15. When the box or pack is turned upright again, the dispensing chamber is refilled with the product which, during the tilting movement, entered the corner of the box adjacent the pouring opening 15. Since the dispensing chamber has only a limited volume, it is unable to accommodate too much product, even as a result of repeated tilting or inversion of the box.

Figure 5:
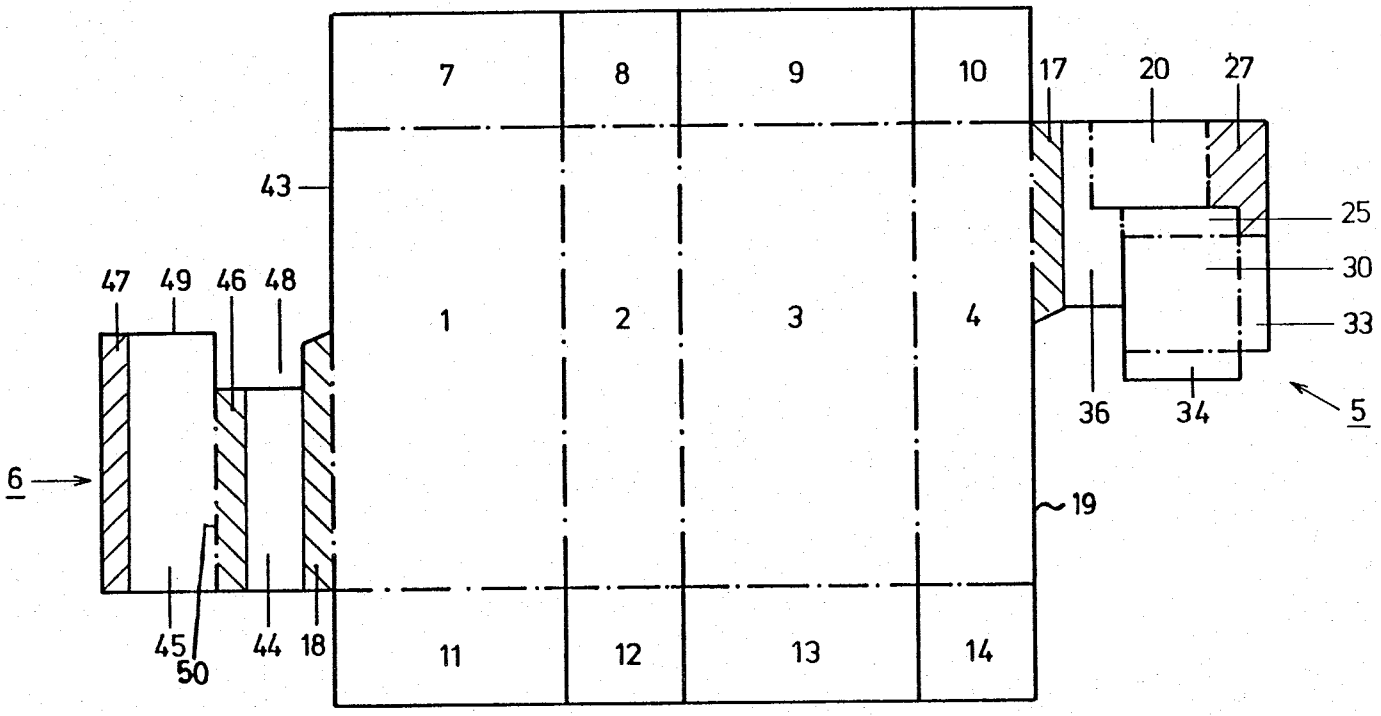
FIG. 5 shows an alternative embodiment of a flat box blank for making a folding box with an integrated dispenser.

FIG. 5 diagrammatically illustrates another embodiment of a flat box blank. The box blank shown in FIG. 5 differs from that shown in FIGS. 1 to 3 primarily in the fact that the individual elements of the dispenser are divided between a fifth side wall generally denoted by the reference 5 and a sixth side wall generally denoted by the reference 6. The elements of the fifth side wall 5 hinged to the pouring side wall through a divided longitudinal glueing flap 17 substantially correspond to the embodiment shown in FIGS. 1 to 3 in regard to the elements 20, 25 and 30 and the flaps and panels associated therewith. Distinguishing features exist primarily in regard to the design of the pressure tongue. According to FIG. 5, the pressure tongue is formed by two carton flaps 44 and 45 integral with the longitudinal edge 43 of the side wall 1 via a longitudinal glueing flap 18. In addition to the longitudinal glueing flap 18, the carton flap 44 comprises a longitudinal glueing flap 46 while the carton flap 45 comprises a longitudinal glueing strip 47. In addition, a notch 48 at the head of the flap 44 is important to the function of the pressure tongue to be formed from the carton flaps 44 and 45.

On erection of the box blank shown in FIG. 5, for example in a box glueing machine, the fifth side wall 5 is first folded through 180° at the crease line 19 onto the side walls 3 and 4, so that the side wall 3 is glued to the glueing surface 27. At the same time, the carton flap 45 of the sixth side wall is folded through 180° at its crease line 50 onto the carton flap 44 so that the pressure flap 44 is glued to the glueing surface 47 on the back of the longitudinal glueing flap 18. Next, the glued cartton flaps 44 and 45 are folded through 180° at the crease line or longitudinal edge 43 onto the side wall 1 so that the carton flap 45 is loosely opposite the side wall 1.

The longitudinal glueing strips 17 and 18 for a powder-tight longitudinal joint when the side wall 1 with the folded-over carton flaps 44 and 45 and the side wall 2 are folded together through 180° onto the side walls 3 and 4 onto the fifth side wall 5. When the walls 1 and 2 with the carton flaps 44 and 45 are folded over, the side wall 4 is glued to the glueing surface 46. After the longitudinal glueing of the folding box, the dispensing chamber base 30 in FIG. 2, which is oblique in relation to the pouring side wall 4, is inclined and held under the pressure of the carton flap 45 folded through a total of 360° and glued. On erection, the lower edge of the dispensing chamber base 30 and the dust flap 34 hinged thereto automatically slide perpendicularly to the longitudinal edge 19 of the pouring wall 4, beginning in the notch 48, under the free edge 49 of the carton flap 45. As in the embodiment shown in FIG. 1, the dust flaps 33 and 34 are again applied tightly to the side walls 3 and 4.

Figure 6:
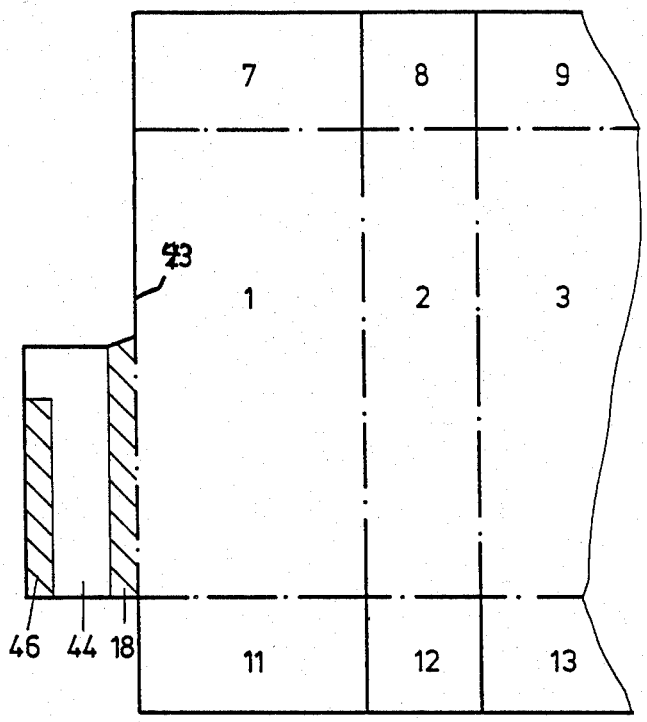
FIG. 6 shows a modification of the box blank of FIG. 5.

Another modification of the folding box shown in FIG. 5 is shown in FIG. 6 wherein the components are substantially the same as in FIG. 5, except that there is no outer carton flap 45. On erection, the carton flap 44 is folded through 180° at the longitudinal edge 43 onto the side wall 1. Otherwise, the box blank is erected in the same way as that shown in FIG. 5.

We claim:

1. A folding box having a pouring opening provided at the upper end of a pouring side wall and an integrated dispenser for freeflowing powder products and granulates preceding said pouring opening located inside the box having an additional or fifth box wall hinged to said pouring side wall, said dispenser comprising a dispensing duct wall which extends across the entire width of said pouring side wall transversely of said pouring opening and which is cut and displaced parallel into the interior of the box at said cut to form a dispensing chamber wall, said dispenser being adapted for connection to the box side wall hinged to said pouring side wall, wherein said dispensing duct wall is cut where it adjoins said pouring opening and wherein said dispensing chamber wall is folded downwards towards said pouring side wall at a predetermined dispensing height below the cut to form a dispensing chamber and is fixed as the base of said dispensing chamber between said pouring side wall and a pressure tongue secured to said pouring side wall.

2. A folding box in accordance with claim 1 wherein the base of said dispenser chamber slopes obliquely downwards from said dispensing chamber wall towards said pouring side wall.

3. A folding box in accordance with claim 1 wherein said dispensing chamber base bears on said pouring side wall via a dust flap hinged to the longitudinal edge of said dispensing chamber base and which edge is located between said pouring side wall and said pressure tongue.

4. A folding box in accordance with claim 1 wherein, after erection, the base of said dispensing chamber abuts the wall of the folding box hinged to said pouring side wall through a dust flap hinged to a side edge which faces away from said pouring side wall prior to erection of said folding box.

5. A folding box in accordance with claim 1 wherein said pressure tongue is formed from said fifth box wall.

6. A folding box in accordance with claim 1 wherein said pressure tongue is formed from a sixth box wall hinged diametrically opposite said fifth box wall.

7. A folding box in accordance with claim 1 wherein an edge of said pressure tongue to be joined to said pouring side wall is doubled by folding over, and wherein the folded over edge is joined on both faces to an adjoining surface.

8. A folding box in accordance with claim 1 wherein said pressure tongue is formed integrally with part of a longitudinal glueing flap used to erect said folding box.

9. A folding box in accordance with claim 1 wherein said pressure tongue is doubled where it is secured to said pouring side wall so that on erection of said box, said dispensing chamber base can be secured beneath said pressure tongue.

10. A folding box having an integrated dispenser and a pouring opening located at the upper end of a pouring side wall of the bix, said integrated dispenser being formed into one piece upon erection of said folding box from a flat box blank, wherein said integrated dispenser is formed from a fifth side wall hinged to said pouring side wall, and said dispenser comprises a dispensing duct wall which extends across the entire width of said pouring side wall transversely of said pouring opening, said dispensing duct wall being cut below the height of said pouring opening and displaced parallel into the interior of said box at said cut to form a dispensing chamber wall, said dispensing chamber wall being folded downwards towards said pouring side wall at a predetermined dispensing height below said cut to form a dispensing chamber wall which is fixed at its base between said pouring side wall and a pressure tongue secured to said pouring side wall.

11. A folding box in accordance with claim 10 wherein said fifth side wall is formed integrally with the longitudinal edge of said pouring side wall.

12. A folding box in accordance with claim 11 wherein said dispensing duct wall is located opposite said pouring opening and has edges in the form of crease lines running parallel to said longitudinal edge of said pouring side wall.

13. A folding box in accordance with claim 12 wherein said dispensing duct wall has an inner edge in the form of a cut line extending parallel to the upper edge of said box.

14. A folding box in accordance with claim 13 wherein said dispensing chamber wall adjoins said dispensing duct wall beyond said cut line.

15. A folding box in accordance with claim 12 wherein a glueing surface adjoins said dispensing duct wall and said dispensing chamber.

16. A folding box in accordance with claim 10 wherein said dispensing chamber wall has a crease line on each side thereof and another crease line on the side opposite the cut line of said dispensing duct wall.

17. A folding box in accordance with claim 16 wherein said crease line on the side opposite the cut line of said dispensing duct wall adjoins said dispensing chamber base with two dust flaps which are hinged via crease lines.

18. A folding box in accordance with claim 10 wherein said dispensing chamber base has an edge facing a longitudinal glueing flap, and said edge is a cut line.

19. A folding box in accordance with claim 10 wherein said dispensing duct wall and said dispensing chamber wall are adjoined to a glueing surface, and said dispensing duct wall, said dispensing chamber wall, said dispensing chamber wall and said glueing surface are joined to a longitudinal glueing flap adjoining the longitudinal edge of said pouring side wall.

20. A folding box in accordance with claim 19 wherein said pressure tongue is formed integrally with said longitudinal glueing flap.

21. A folding box in accordance with claim 20 wherein said pressure tongue comprises two glueing flaps and a carton flap.

* * * * *